US008006743B2

(12) United States Patent
Weyer et al.

(10) Patent No.: US 8,006,743 B2
(45) Date of Patent: Aug. 30, 2011

(54) METHOD AND DEVICE FOR DETERMINING THE POSITION OF THE SOLIDIFICATION POINT

(75) Inventors: Axel Weyer, Wuppertal (DE); Albrecht Girgensohn, Düsseldorf (DE)

(73) Assignee: SMS Siemag AG, Duesseldorf (DE)

( * ) Notice: Subject to any disclaimer, the term of this patent is extended or adjusted under 35 U.S.C. 154(b) by 476 days.

(21) Appl. No.: 10/586,799

(22) PCT Filed: Jan. 13, 2005

(86) PCT No.: PCT/EP2005/000256
§ 371 (c)(1),
(2), (4) Date: Aug. 7, 2008

(87) PCT Pub. No.: WO2005/068109
PCT Pub. Date: Jul. 28, 2005

(65) Prior Publication Data

US 2008/0308251 A1 Dec. 18, 2008

(30) Foreign Application Priority Data

Jan. 20, 2004 (DE) ..... 10 2004 002 783

(51) Int. Cl.
*B22D 11/16* (2006.01)
*B22D 11/20* (2006.01)

(52) U.S. Cl. ..... 164/452; 164/154.1; 164/454; 164/413

(58) Field of Classification Search ..... 164/452, 164/454, 484, 413, 154.1, 154.5
See application file for complete search history.

(56) References Cited

U.S. PATENT DOCUMENTS

| | | | | |
|---|---|---|---|---|
| 5,348,074 | A | 9/1994 | Streubel | |
| 5,511,606 | A * | 4/1996 | Streubel | 164/476 |
| 6,371,197 | B2 * | 4/2002 | Weyer et al. | 164/454 |
| 6,427,758 | B1 * | 8/2002 | Klassen | 164/454 |
| 6,491,088 | B1 * | 12/2002 | Sucker et al. | 164/454 |
| 6,533,024 | B2 * | 3/2003 | Streubel et al. | 164/454 |
| 6,701,999 | B2 * | 3/2004 | Von Wyl et al. | 164/484 |
| 6,880,616 | B1 | 4/2005 | Kemna et al. | |
| 6,883,586 | B2 * | 4/2005 | Weyer et al. | 164/484 |
| 7,025,118 | B2 * | 4/2006 | Streubel et al. | 164/454 |
| 7,069,974 | B2 * | 7/2006 | Rittner et al. | 164/454 |

(Continued)

FOREIGN PATENT DOCUMENTS

CA 2495042 2/2005

(Continued)

OTHER PUBLICATIONS

K. Harste, et al., Neubau einer Verticalstranggissanlage . . . , Stahl und Eisen, 117, Nov. 11, 1997, pp. 73-79.

(Continued)

*Primary Examiner* — Kevin P Kerns
(74) *Attorney, Agent, or Firm* — Abelman, Frayne & Schwab

(57) ABSTRACT

A method of and a device for determining the position of the solidification point (1*a*) in a strand (1) during continuous casting of liquid metals, in particular of steel, lead to precise results, while an indirect measurement of a movable amount of a core liquid volume per unit of length is carried out by direct measurement of generated process parameters by force and/or path signals on fixed or adjustable individual support rollers or groups of fixed or adjustable support roller pairs, and based on the measurement values, a calculation model for a momentary position of the solidification point (1*a*) is produced, based on which, changeable casting parameters are continuously adjusted.

11 Claims, 3 Drawing Sheets

U.S. PATENT DOCUMENTS

| | | | |
|---|---|---|---|
| 2004/0026066 | A1 | 2/2004 | Rahmfeld et al. |
| 2004/0129405 | A1 | 7/2004 | Streubel et al. |
| 2005/0045304 | A1 | 3/2005 | Geerkens et al. |

FOREIGN PATENT DOCUMENTS

| | | |
|---|---|---|
| DE | 10045250 | 3/2002 |
| EP | 0743116 | 11/1996 |
| EP | 0903192 | 3/1999 |
| JP | 1-271 047 | 10/1989 |
| JP | 11-192 539 | 7/1999 |
| JP | 2000-288 696 | 10/2000 |
| JP | 2000-334 552 | 12/2000 |
| JP | 2002-066 704 | 3/2002 |
| JP | 2003-245 762 | 9/2003 |
| WO | WO 02/090019 A1 * | 11/2002 |

OTHER PUBLICATIONS

H.-P. Narzt, et al., Productinnovationen und Qulitatverbesserung . . . , Stahl und Eisen, 123 Nov. 5, 2003, pp. 77-79.

H. Noedl, et al., Advanced Equipment for High-Performance Casters, MPT Int., Nov. 3, 2003, pp. 74-80.

K. Noerwald, et al. Roll Load Measurements . . . , Ironmaking and Steelmaking, v. 25, Nov. 2, 1998, pp. 159-162.

* cited by examiner

METHOD AND DEVICE FOR DETERMINING THE POSITION OF THE SOLIDIFICATION POINT

BACKGROUND OF THE INVENTION

1. Field of the Invention

The invention relates to a method of and a device for determining a position of a solidification point in a strand during a continuous casting of liquid metals, in particular liquid steel, in which a strand formed in a continuous casting mold as a billet, ingot, bloom, preliminary section, thin slab, or slab strand, is displaced in support roller segments, is cooled, and is drawn out by support roller segments with driven support roller pairs. During production of above-mentioned elongate products with a continuous casting method, the cast initial material should meet high requirements with respect to its inner quality. Of large importance is as uniform as possible distribution of alloy elements over the entire strand cross-section, without a damaging segregation that may occur in the strand center and in inner cracks.

2. Description of the Prior Art

Known is an electromagnetic stirring process in which a strand stirrer operates in the region of final solidification, and the time at which the desired action of the stirrer should reach the core melt, depends on the position of the solidification point. Because the solidification point is not known or is uncertain, in all cases, displacement of the device in the strand displacement direction is necessary.

Also known is a so-called soft-reduction process in which the strand thickness is reduced in the region of final solidification to thereby press back residual melt enriched with alloy elements. The known method aims at circulating or distribution of the core melt.

It is, therefore, necessary to be able to determine the solidification point length as precisely as possible. To this end, a calculation model was developed based on relevant data such as, e.g., casting speed, amount of cooling water, kind of steel, or steel entry temperature.

The precision of the calculation model depends on the reliability of the available process data and on the influence of non-model-forming process parameters. To this, changes in physical characteristics of the strand or other process variables should be taken into account. Thus, elasto-plastic behavior of a completely solidified strand differs from that of only partially solidified strand. Also are available other methods of determining the degree of solidification such as, e.g., determining the force of drawing out the strand through the support roller system of a continuous casting machine, and measuring the support force at segment or driven rollers (EP 1197007 A1).

The object of the invention is to achieve a determination of the position of the solidification point in a strand more precise than with all of other known methods.

SUMMARY OF THE INVENTION

The object of the invention is achieved according to the invention in that an indirect measurement of a movable amount of a core liquid volume per unit of length is carried out by direct measurement of generated process parameters by force and/or path signals on fixed or adjustable individual support rollers or groups of fixed adjustable support roller pairs, and based on the measurement values, a calculation model for a momentary position of the solidification point is produced, based on which, changeable casting parameters are continuously adjusted. The principle is based on changing or displacing the liquid volume during otherwise constant casting conditions by specific movements of support roller segments or individual support rollers or other elements at different points along the strand displacement from a region immediately below the continuous casting mold up to the maximal theoretical point of complete solidification of the strand. Thereby, it can be particularly determined whether the strand still has, at a predetermined time point at a predetermined location, a liquid core, smaller or greater partial solidification or has completely solidified.

According to an embodiment of the invention, it is contemplated that the measurement signal is based on a local change of the strand thickness. This measure can be advantageous in many applications:

With formats for slab, ingot and billet strands, a local change of the format thickness by displacement of one or several drive rollers in the region of a partially solidified strand can provide the necessary information.

CSP-installations (compact-strip-plants), billet strand casting machines with drive stands in form of segments and slab casting machines (with Cyber-Link segments), the format thickness can be changed by displacing a support roller segment (without an independently adjustable drive roller) with an adequate speed in the region of the partially solidified strand.

In slab casting machines, the change of the format thickness by displacement of a segment (with an independently adjustable individual roller) with an adequate speed in the region of the partially solidified strand, indicates the displacement of the liquid core volume.

A further casting parameter can be determined when measurement signals are based on a change of a stop plug position or a value position in an intermediate receptacle in front of the continuous casting mold. The change of the stop plug position produces displacement of the volume that can be detected.

Another measurement possibility consists in that measurement signals are based on changes of a melt level in the continuous casting mold. This measure also can indicate displacement of the volume.

It is further contemplated that measurement signals are based on changeable volume of liquid metal that flows between an intermediate receptacle and the continuous casting mold. Thereby, corresponding feedbacks are produced in the strand and the strand crater.

An indirect measurement of the volume displacement is effected with measurement signals based on changes of clamping forces between support roller pairs or support roller segment sides. Here, the conclusion with respect to volume displacements is possible, though the support roller segments or support roller pairs do not actively act on the displacement of the core liquid volume.

According to a further embodiment, dependent on the calculation model, an automatic adjustment of a support roller segment or an adjustable support roller is carried out. Thereby, the above-discussed adjustment of changeable casting parameters becomes possible.

The use of measurement results as a feedback for a control activity consists in that a sequence of position or force changes in a same system direction on the strand is undertaken from bottom upwards or in reverse.

A device for determining a position of solidification point in a strand of liquid metal, in particular of liquid steel, proceeds from a known device with an intermediate receptacle, with a continuous casting mold for a billet, ingot, bloom, preliminary section, thin slab, or slab strand format, and with support roller segments or roller pairs with drive support rollers.

The object of the invention is achieved in that there are provided signal transmitters in hydraulic piston-cylinder units of the support roller segments or of adjustable, free-running, or drive individual rollers, and which are connected with a central memory and data processing unit in which measurement result are processed, and a calculation model is used for determining a momentary position of a core liquid volume inside still liquid strand. Thereby, there is provided means for indirect measurement of casting parameters and direct formation of a calculation model.

According to an embodiment of the device, a support roller segment without independently adjustable drive separate support roller on a loose side, is adjusted, dependent on a position and width of local and temporarily solidification point, by two piston-cylinder units spaced in a strand displacement direction below or above at an angle to the strand displacement direction.

According to a further development, the independently adjustable, drive support roller pair on a loose side, in addition to adjustment of the mentioned above support roller segments, dependent on the position and the width of the local and temporarily solidification point, is adjusted with a piston-cylinder unit. Thereby, the solidification point can be locally determined by a transition from reaction to non-reaction.

BRIEF DESCRIPTION OF THE DRAWINGS

The drawings show embodiments of the invention on the basis of which the method would be explained in detail.

The drawings show.

DETAILED DESCRIPTION OF THE PREFERRED EMBODIMENT

Figure 1:
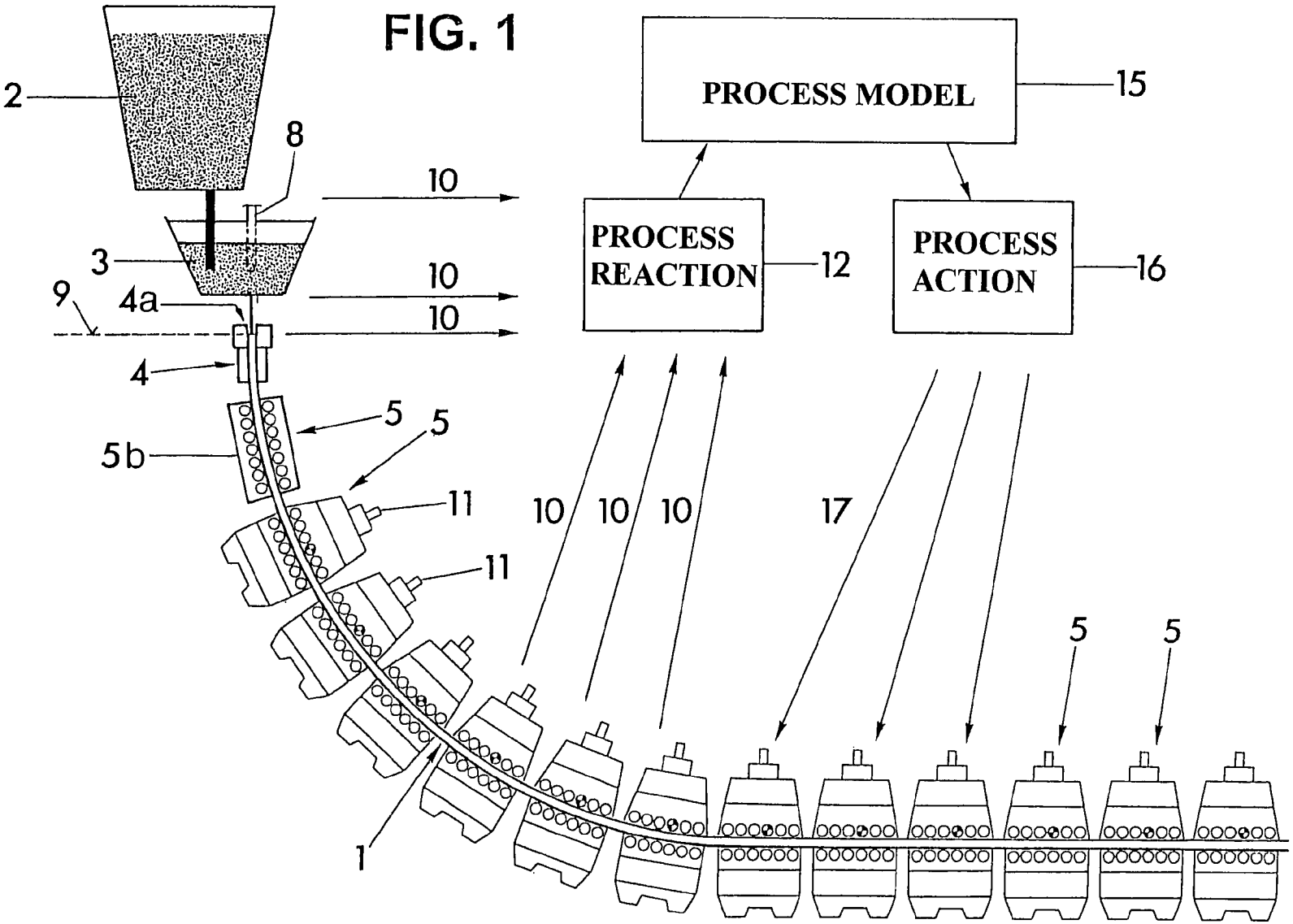
FIG. 1 a side view of a slab continuous casting machine with signal transmitters.

A slab continuous casting machine according to FIG. 1 serves as a basis for explaining the method of determining of a momentary position of a solidification point in a cast strand 1. Liquid steel is poured from a teeming ladle 2 in a controlled manner into an intermediate receptacle 3 from which steel flows into a continuous casting mold 4. The format 4*a* can represent billet, ingot, bloom, preliminary section, thin slab, slab strand formats. The cast strand 1 moves through a support roller segment 5 through a secondary cooling zone, wherein one support roller segment 5*b* is not adjustable. The support roller segment 5 is followed by other support roller segments 5 which are arranged along an arch passing into a horizontal. The further support roller segments 5 can be differently formed.

The strand 1 is displaced by drive support roller pairs 6, separate rollers 6*a* which can be adjustable, drive or non-drive. The support roller pairs 6 form groups 7 of support rollers (FIGS. 2A and 2B) or support roller pairs 7*a*. The inflow of the liquid steel can be controlled by different positions of a stop plug 8. Thereby, the melt level 9 in the continuous casting mold is controlled. All of the above-described elements, components, and functions have a signal transmitter 10. The adjustment of a distance between rollers is effected with piston-cylinder units 11 in the cylinder chambers of which such signal transmitters are also arranged. The signals from the signal transmitters 10 are communicated to a central memory and data processing unit 12. The support roller segments 5 form, in addition, a fixed side 13*a* (left side) and a loose side 13*b* (right side).

The strand 1 is displaced from the continuous casting mold 4 through a series of support roller segments in a strand displacement direction 14.

Figure 2A:
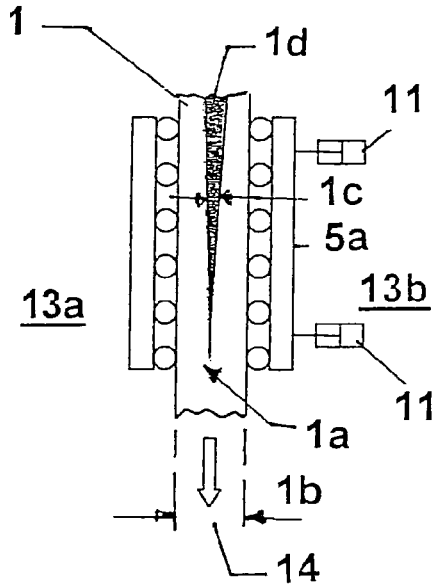
FIG. 2A a support roller segment for a cast strand with a liquid core and a solidification point without an independently adjustable drive roller.
Figure 3A:
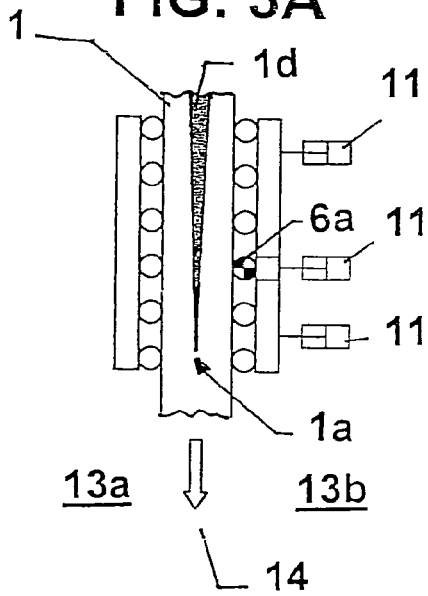
FIG. 3A a support roller segment for a cast strand with a liquid core and a solidification point with an independently adjustable drive roller.

The method is based on an indirect measurement of changeable amounts of the volume of core liquid in the strand crater 1*d* that can vary, in FIGS. 2A and 3A, in the strand thickness 1*b* with a width 1*c* in the solidification point 1*a* and within the strand crater 1*d*, over the thickness 1*b* (and a non-visible width transverse to the plane of the drawings). The signal transmitters 10 send measurement signals (per unit of length or over the full length of the measurable strand crater 1*b*) and which are input in the central memory and data processing unit 12 (FIG. 1) as process parameters. The signals are generated primarily by force and/or path measurements at fixed or adjustable separate support rollers 6*a* or at groups 7 of fixed or adjustable support roller pairs 7*a*. Based on the signals of one or several signal transmitters 10, a calculation model (computer program) 15 is developed for determining a momentary position of the solidification point 1*a*, with a subsequent, if necessary, correction of the measurement points, separately or dependent on each other, by a process control 16 in order to adapt the cast parameters to a changed situation. The measurement signal can correspond to a local change of the strand thickness 1*b*. Other measurement signals can be based on change of a position of the stop plug 8 or a valve position in the intermediate receptacle 3 in front of the continuous casting mold 4. Other measurement signals are generated by changes in the melt level in the continuous casting mold 4. Those can be followed by measurement signals of cooling medium temperatures in the continuous casting mold 4. Also, measurement signals, which reflect changes in the feeding volume of liquid steel between the intermediate receptacle 3 and the continuous casting mold can be taken into account. Important measurement signals are generated by changes of the clamping force between the support roller pairs 7*a* or between the support roller segments 5*a*. Dependent on the calculation model 15, an automatic adjustment of a support roller segment 5 or of an adjustable support roller 6*a* takes place as a result of process signals 17. Finally, a sequence of position and force changes in a same system direction of the strand 1 from bottom upwards or (in reverse) in the strand displacement direction 14 can be effected.

The measurement signals, which are to be inputted in the calculation model 15, can be selected as separate signals, as groups of selected signals, or as a totality of all measurement signals.

According to FIG. 2A, on the fixed side 13*a* and on the loose side 13*b*, there are provided support roller segments 5 the distance between the rollers of which form the strand thickness 1*b*. In the strand 1 displaceable in the strand displacement direction, the strand crater 1*d* has a continuously reduced widths 1*c* up to the solidification point 1*a*. On the support roller segment side 5*a*, the support roller segment 5 is pivoted by the hydraulic piston-cylinder units 11, which engage the ends, according to FIG. 2B, as a group 7 at the bottom, inwardly or outwardly, dependent on the measurement signals, whereby a parallel arrangement (left drawing), an inwardly pivoted position (middle drawing), with a strand 1 that becomes colder, and an outwardly pivoted position (right drawing) can be produced.

Figure 2B:
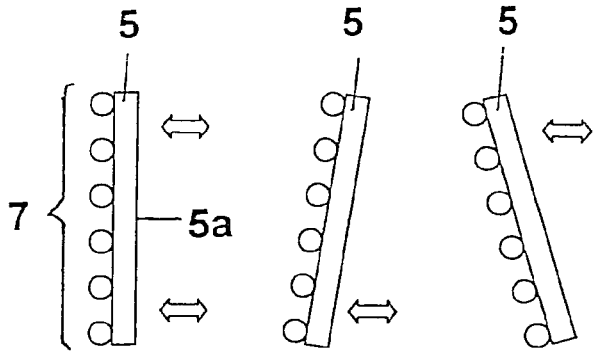
FIG. 2B degrees of freedom of a support roller segment on the loose side.
Figure 3B:
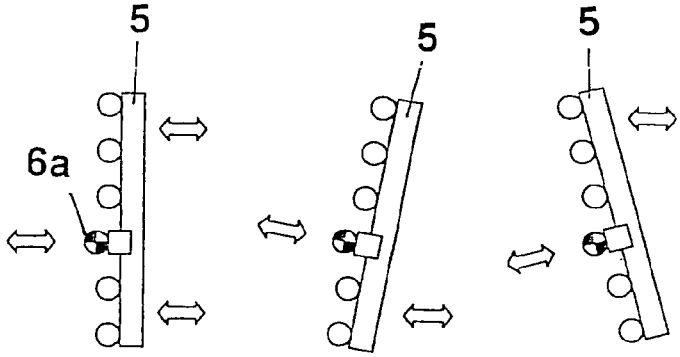
FIG. 3B degrees of freedom of a support roller segment with a drive roller on the loose side.

In FIGS. 3A and 3B, the mentioned local changes of the strand thickness 1*b* take place: the separate support rollers 6*a* can be additionally readjusted in the arrow directions shown in FIG. 3B during the adjustment displacements according to FIG. 2B.

Figure 4:
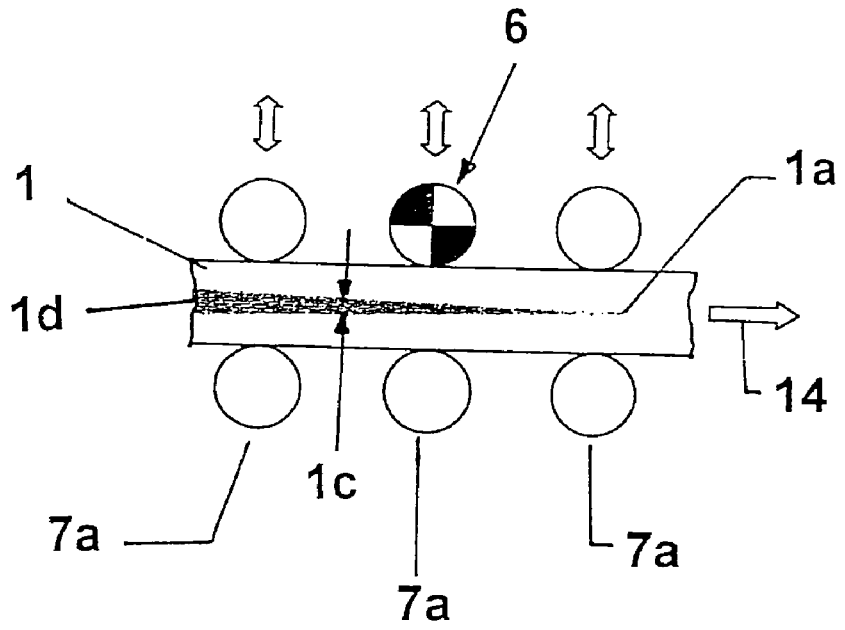
FIG. 4 a separate support roller with or without drive on a partially solidified cast strand.

In FIG. 4, there are provided support roller pairs 7*a* individual rollers of which are adjustable. Such individual rollers can be realized as drive support roller pairs 6 wherein only one of the support rollers is adjustable. The strand 1 is shown in a horizontal position in the strand displacement direction 14, however, it applies to a transverse and/or arch-shaped region.

Figure 5:
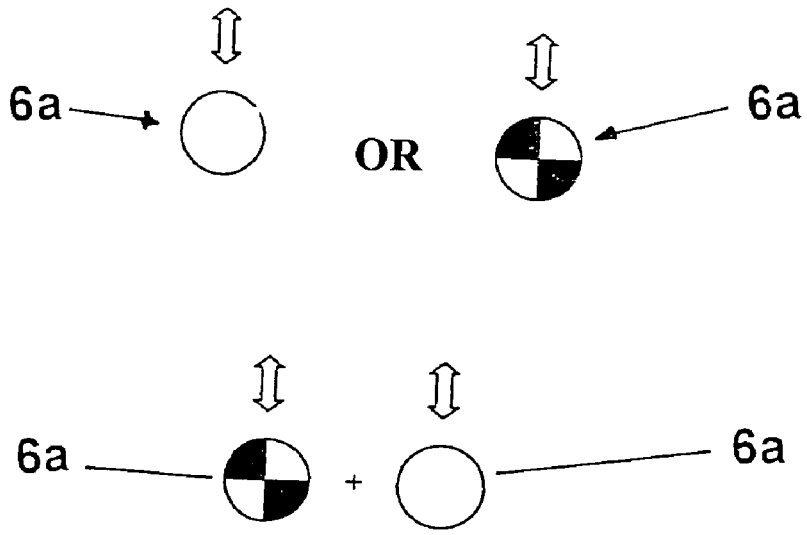
FIG. 5 degrees of freedom of a non-driven and drive separate support roller, alone and in combination.

According to FIG. 5, such individual rollers 6*a* are free-running (left) or drive (right). A driven and adjustable individual roller 6*a* can be used in combination with a non-driven but adjustable individual roller 6*a*.

The determined position of the solidification point 1*a* leads to the handling of the strand crater 1*d*, as mentioned at the beginning, so that uniform distribution of alloy elements in the core zone of a respective strand format 4*a* of the strand 1 is produced.

LIST OF REFERENCE NUMERALS

1. Strand
1*a*. Solidification point
1*b*. Strand thickness
1*c*. Width of the solidification point
1*d*. Strand crater
2. Teeming ladle
3. Intermediate receptacle
4. Continuous casting mold
4*a*. Format
5. Support roller segment
5*a*. Support roller segment side
5*b*. Support roller segment without adjustment
6. Driven support roller pair
6*a*. Individual support roller
7. Groups of support rollers
7*a*. Support roller pair
8. Stop plug
9. Melt level of the continuous casting mold
10. Signal transmitter
11. Hydraulic piston-cylinder unit
12. Central memory and data processing unit
13*a*. Fixed side
13*b*. Loose side
14. Strand displacement direction
15. Calculation model
16. Process control
17. Process signals

The invention claimed is:

1. A method of determining a position of a solidification point in a strand (1) during a continuous casting of liquid metals and wherein the strand (1) formed in a continuous casting mold (4) and is displaced in support roller segments (5) provided with drive support roller pairs (6), the method comprising the steps of indirectly measuring a movable amount of a core liquid volume by direct measurement of generated process parameters on fixed or adjustable individual support rollers (6*a*) or groups (7) of fixed or adjustable support roller pairs (7*a*) with signal transmitters (10) which generate respective force and/or path signals which represent continuously changeable momentary positions of the solidification point in the cast strand (1) produced by continuous movement of the solidification to different locations along an entire solidification stretch during casting of the cast strand; producing a calculation model (15) for each momentary position of the solidification point (1*a*) based on the force and/or path signals; and continuously adjusting changeable casting parameters based on respective calculated positions of the solidification point.

2. A method according to claim 1, wherein the force and/or path signals are based on a local change of a strand thickness.

3. A method according to claim 1, wherein the force and/or path signals are based on a change of at least one of stop plug position (8) and/or a valve position in an intermediate receptacle (3) provided between the continuous casting mold (4) and a teeming ladle.

4. A method according to claim 1, wherein the force and/or path signals are based on changes of a melt level (9) in the continuous casting mold (4).

5. A method according to claim 1, wherein the force and/or path signals are based a changeable volume of liquid metal that flows between an intermediate receptacle (3) and the continuous casting mold.

6. A method according to claim 1, wherein the signal transmitters generate force signals based on changes of clamping forces between support roller pairs (7*a*) or support roller segment sides (5*a*).

7. A method according to claim 1, wherein dependent on the calculation model (15), an automatic adjustment of a support roller segment (5) or an adjustable support roller (6*a*) is carried out.

8. A method according to claim 1, wherein a sequence of position or force changes in a same system direction on the strand (1) is undertaken from bottom upwards or in reverse.

9. A method according to claim 1, wherein a support roller segment (5) without independently adjustable, drive separate support roller (6*a*), on a loose side (13*b*), is adjusted, dependent on a position and width (1*a*) of a local and temporary solidification point (1*a*), by two piston-cylinder units (11) spaced in a strand displacement direction (14) below or above at an angle to the strand displacement direction (14).

10. A method according to claim 1, wherein independently adjustable, driven support roller pair (6) on, a loose side (13*b*), in addition to adjustment of a support roller segment (5), dependent on the position and the width (1*c*) of the local and temporary solidification point (1*d*), is adjusted with a piston-cylinder unit (11).

11. A device for determining a position of solidification point (1*a*) in a strand (1) during a continuous casting of liquid metals and wherein the strand (1) is formed in a continuous casting mold (4) and is displaced in support roller segments (5) or roller pairs (6) provided with driven support rollers (6*a*), the device comprising hydraulic piston-cylinder units (11) for adjusting the support roller segments; signal transmitters (10) provided in an intermediate receptacle (3) that is located between a teeming ladle (2) and the continuous casting mold (4), in the continuous casting mold (4), in the hydraulic piston-cylinder units (11) of the support roller segments (5) and/or on adjustable, free-running, or driven individual rollers (6*a*) for generating force and/or path signals which represent continuously changeable temporary positions of the solidification point in the cast strand (1) produced by continuous movement of the solidification point to different locations along an entire solidification stretch during casting of the cast strand; and data processing unit (12) for processing force and/or path signals and for producing a calculation model (15) used for calculating respective momentary positions of the solidification point based on which changeable casting parameters are continuously adjusted.

* * * * *